United States Patent [19]

Strauss

[11] Patent Number: 4,994,712

[45] Date of Patent: Feb. 19, 1991

[54] FOIL SHADOW MASK MOUNTING WITH LOW THERMAL EXPANSION COEFFICIENT

[75] Inventor: Paul Strauss, Chicago, Ill.

[73] Assignee: Zenith Electronics Corporation, Glenview, Ill.

[21] Appl. No.: 358,928

[22] Filed: May 3, 1989

[51] Int. Cl.[5] ..... H01J 29/07

[52] U.S. Cl. ..... 313/405; 313/407

[58] Field of Search ..... 313/404, 405, 407

[56] References Cited

U.S. PATENT DOCUMENTS

| | | | |
|---|---|---|---|
| 2,611,100 | 9/1952 | Faulkner et al. | 313/404 |
| 3,392,297 | 7/1968 | Schwartz . | |
| 3,970,456 | 7/1976 | Branton . | |
| 4,193,011 | 3/1980 | Pollehn et al. . | |
| 4,547,695 | 10/1985 | Rath | 313/407 X |
| 4,623,820 | 11/1986 | Deal et al. . | |
| 4,695,761 | 9/1987 | Fendley | 313/407 |
| 4,729,907 | 3/1988 | Deal et al. . | |
| 4,748,370 | 5/1988 | van den Broek | 313/404 |
| 4,827,178 | 5/1989 | Higashinakagawa et al. X | 313/407 |
| 4,891,544 | 1/1990 | Capek et al. | 313/407 X |

FOREIGN PATENT DOCUMENTS 0121628 10/1984 Fed. Rep. of Germany .

*Primary Examiner*—Palmer C. DeMeo

[57] ABSTRACT

A mounting arrangement for a foil shadow mask includes a plurality of elongated, generally linear spacers affixed to an inner surface of the flat glass faceplate of a color cathode ray tube (CRT) and arranged in a generally rectangular array. Attached to each spacer substantially along the length thereof is a respective elongated mounting spring. Each mounting spring includes a first portion attached to its associated spacer and a second flexible, resilient U-shaped portion to which a mask anchor is securely attached. Each peripheral edge portion of the foil shadow mask is attached to a respective mask anchor for maintaining the foil shadow mask in registration with light emitting phosphor elements on the CRT's faceplate. The mounting springs allow the glass faceplate as well as glass-based spacers to which the mounting springs are attached to expand during high temperature processing encountered in CRT fabrication without exceeding the foil shadow mask's tensile stress limits while maintaining the foil shadow mask in registration with the phosphor elements during lower temperature operation. Another embodiment contemplates a monolithic bi-metallic structure attached to the glass faceplate as well as to the foil shadow mask which is inflexible at lower operating temperatures to maintain the foil shadow mask in registration yet flexes at higher CRT processing temperatures during manufacture to allow for expansion of the glass faceplate without exceeding mask tensile stress limits.

24 Claims, 2 Drawing Sheets

FOIL SHADOW MASK MOUNTING WITH LOW THERMAL EXPANSION COEFFICIENT

BACKGROUND OF THE INVENTION

This invention relates generally to color cathode ray tubes (CRTs) having a shadow mask and is particularly directed to a mounting arrangement for a shadow mask of the tension foil type in a color CRT wherein the mount for the mask is in fixed relationship to the CRT faceplate.

The use of a tensioned foil shadow mask in a color CRT affords many advantages over conventional domed shadow masks. Chief among these is a greater power handling capability which makes possible as much as a three-fold increase in video image brightness.

A shadow mask serves as a color selection electrode, or parallax barrier, ensuring that each of the three electron beams lands only on its assigned phosphor elements, or deposits. A large percentage of the electrons directed towards the phosphor screen deposited on the glass faceplate are intercepted by the shadow mask, which therefore heats up during CRT operation. The elevated operating temperatures can cause the mask to undergo small but significant changes in both size and shape, the latter commonly referred to as "doming."

In order to preserve the critical geometric relationship between the shadow mask aperture array and the phosphor screen required for a high level of color purity, thermally induced size changes of the shadow mask are conventionally accommodated by supporting the shadow mask with compensating spring arrangements which allow the shadow mask to move towards the screen with increased shadow mask size and away from the screen with decreased shadow mask size while maintaining transverse registry with the screen.

Thermally induced shadow mask surface shape changes are addressed in color CRT designs which employ tensed foil shadow masks, thus utilizing the shape consistency of a taut planar membrane. Such CRT designs require that some tension be retained in the foil throughout its operational temperature range and that at the same time the periphery of the foil shadow mask be precisely controlled relative to the phosphor screen on the glass faceplate. An approach which combines size compensating foil shadow mask support springs with a taut foil shadow mask is disclosed in van den Broek U.S. Pat. No. 4,748,370.

Another approach utilizes the shape stability of a foil shadow mask and at the same time eliminates the critical manufacturing problems and performance limitations associated with shadow mask support compensation devices which must function during operation of the CRT. Examples of a fixed mask mount construction can be found in U.S. Pat. Nos. 4,547,695 to Rath and 4,695,761 to Fendley, the latter of which is assigned to the assignee of the present application. In this approach, a foil shadow mask is tensed in a fixture and then welded to a rigid support structure bonded to a flat glass faceplate. The overall size of the foil shadow mask is retained in fixed relationship to the phosphor screen. This size stability translates to a position stability of all apertures comprising the foil shadow mask array. During operational electron heating of the foil shadow mask, some tension will be lost; but the foil shadow mask array apertures remain stationary provided only that the heating is relatively uniform across the array. As a result, all electron beams will land only on their assigned phosphor deposits without requiring compensation for the critical spacing between the foil shadow mask and the phosphor screen. This critical spacing parameter is commonly called the "Q-Distance", which for the combination of a flat shadow mask shape and a flat screen is the same at all locations.

Electron beam landing precision in such a structure requires sufficient foil shadow mask pretension to counter the relaxation encountered during operational heating of the foil and sufficient rigidity in the support structure to accommodate the variation in tension in the foil shadow mask.

The effects of overall heating of a shadow mask with respect to potential changes in its size and surface shape have been addressed. In this context, the use of low coefficient of thermal expansion mask materials is generally beneficial, since mask shape variations with temperature are minimized by such materials. For the same reason, low thermal coefficient materials also enhance color purity performance for the case of non-uniform heating of the shadow mask which occurs when a portion of the display raster is made very bright while the remainder is dark. This type of mask deformation can be detrimental with all shadow mask types and mounting arrangements. In general, degradation of color purity caused by localized shadow mask heating cannot be compensated for, only minimized. In the case of a foil shadow mask in a fixed mount, mask apertures in the hotter regions of the array will be slightly displaced in the direction of the colder region of the array.

The amount of pretension required in a foil shadow mask fixed mounting approach determines, to a large extent, the structure employed in such designs. The sectional properties of the foil shadow mask support structure required to provide a high degree of stiffness must be compatible with the requirements for bonding that structure to the glass faceplate. The footprint width of the structure necessary to maintain the tension and integrity of the bond must be evaluated in regard to the real estate available on the glass panel. In addition, if the support structure is nonmetallic, a foil shadow mask anchoring element must be bonded to the structure. Finally, weld integrity at the periphery of the foil shadow mask is directly related to the required mask pretension.

All structural considerations are ameliorated with reduced pretension requirements. The pretension is determined by the operational temperature difference between the foil shadow mask and the CRT glass as well as the thermal and mechanical properties of the foil shadow mask material itself. Due to electron interception, a foil shadow mask may rise in temperature in the order of 100° C. during CRT operation, while the glass remains relatively cool. In this environment, a foil shadow mask made of cold rolled steel 0.001 inches thick will require a pretension in the order of 40 pounds per linear inch. A mask of the same thickness made of a very low coefficient of thermal expansion material, such as Invar, might require only about five pounds per linear inch if minimum tension alone were the consideration.

A fundamental problem exists in the fabrication and processing of color CRT's of the type utilizing a fixed mounting of a tensed foil shadow mask if the foil shadow mask material has a very low thermal expansion coefficient. Tube frit sealing and exhaust processing temperatures are in the order of 435° C., a temperature which is attained by both foil shadow mask and faceplate glass during assembly and production processing. A tensed foil shadow mask affixed to a rigid mount on the glass envelope and which is comprised of a material such as cold rolled steel having a thermal expansion coefficient greater than glass will simply relax all pretension when the assembly is subject to the typical CRT processing temperatures. On the other hand, a pretensed foil shadow mask made of material such as Invar (Trademark for a nickel-iron alloy with low thermal expansion), having a thermal expansion coefficient only a fraction that of glass, can be strained beyond its elastic limit if rigidly mounted in a CRT envelope when subjected to high CRT processing temperatures. Furthermore, many low expansion materials such as Invar exhibit greatly reduced mechanical strength at the elevated CRT processing temperatures, further increasing the likelihood of the foil shadow mask array being permanently deformed out of specification.

The purpose of this invention is to provide an arrangement for mounting in a color CRT a tensed foil shadow mask comprised of a material having a lower thermal expansion coefficient than that of glass. The inventive mounting arrangement provides the advantages of a fixed non-compensating approach during CRT operation; yet prevents mask over stressing and possibly even allows for a reduction in foil shadow mask pretension during high temperature CRT processing. The foil shadow mask mounting arrangement of the present invention is particularly adapted for use with mask materials having low thermal expansion coefficients which allow for a reduction in foil shadow mask tension. This reduction in tension permits the use of thinner support rails and facilitates mask installation. The foil shadow mask is attached to a spacer structure mounted to the inner surface of the CRT's glass faceplate by means of a plurality of flexible, resilient mounting springs. The mounting springs allow the glass components of the CRT to expand during high temperature CRT processing without exceeding the foil shadow mask's tension stress limits, while maintaining the foil shadow mask in registration with the phosphor deposits following CRT assembly and during lower temperature CRT operation. In another embodiment, a monolithic bi-metallic spacer structure mounted to the faceplate's inner surface is also directly coupled to the foil shadow mask and is inflexible at CRT operating temperatures to maintain the foil shadow in registration yet flexes at higher CRT processing temperatures during manufacture to allow for glass faceplate expansion without exceeding mask tensile stress limits.

OBJECTS OF THE INVENTION

Accordingly, it is an object of the present invention to provide an improved mounting arrangement for a tension foil type shadow mask in a color CRT.

It is another object of the present invention to limit, and in some cases even reduce, the mechanical load on a foil shadow mask during CRT manufacture processing.

Yet another object of the present invention is to eliminate stretching of a shadow mask of the tension foil type having a low coefficient of expansion beyond its elastic limit during high temperature manufacture processing of a color CRT.

A further object of the present invention is to compensate for differences in the thermal expansion coefficients of a metallic foil shadow mask in a color CRT and the combination of its flat glass faceplate and attachment structures during high temperature processing of the CRT to avoid overstressing of the foil shadow mask and maintain precise alignment between the foil shadow mask's apertures and phosphor elements disposed on the faceplate during lower temperature CRT operation.

BRIEF DESCRIPTION OF THE DRAWINGS

The appended claims set forth those novel features which characterize the invention. However, the invention itself, as well as further objects and advantages thereof, will best be understood by reference to the following detailed description of a preferred embodiment taken in conjunction with the accompanying drawings, where like reference characters identify like elements throughout the various figures, in which:

DESCRIPTION OF THE PREFERRED EMBODIMENTS

Figure 1:
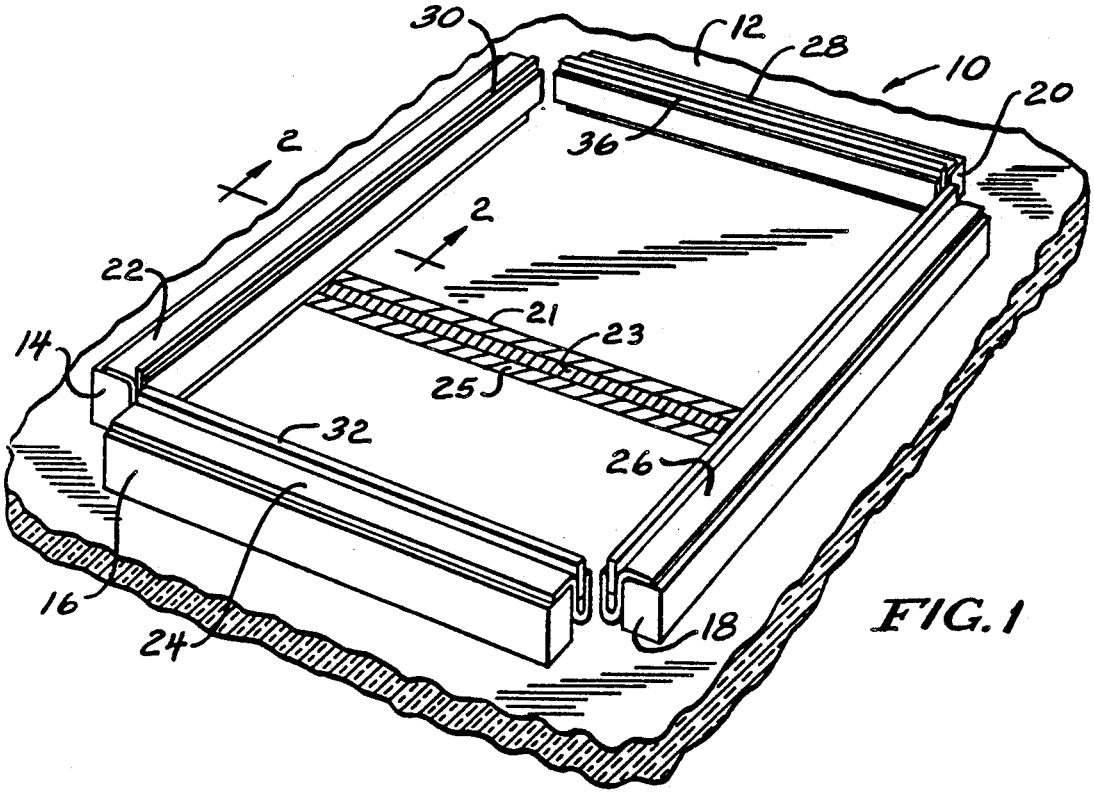
FIG. 1 is a perspective view of a foil shadow mask mounting arrangement in accordance with the present invention positioned on the glass faceplate of a color CRT.

Referring to FIG. 1, there is shown a perspective view of a foil shadow mask mounting arrangement 10 in accordance with the principles of the present invention. The foil shadow mask mounting arrangement 10 is positioned on a portion of a flat glass faceplate, or panel, 12 of a CRT. Disposed on the inner surface, or upper surface as shown in FIG. 1, of the glass faceplate 12 are a large number of triplets of phosphor lines. Each phosphor line triplet includes a line of red luminescing phosphor 21, green luminescing phosphor 23, and blue luminescing phosphor 25. A large number of phosphor line triplets are disposed in a sequential, closely spaced array on a portion of the inner surface of the glass faceplate 12. While the phosphor deposits are shown in the form of lines in the figure, the present invention is also adapted for use with arrays of phosphor dot triplets on the faceplate.

Also positioned on the inner surface of the glass faceplate and disposed about the aforementioned phosphor line triplets is the foil shadow mask mounting arrangement 10 of the present invention. The foil shadow mask mounting arrangement 10 includes first, second, third and fourth spacers 14, 16, 18 and 20 forming a generally rectangular array on the inner surface of the glass faceplate 12. A foil shadow mask, or color selection electrode (not shown in FIG. 1 for simplicity), is securely attached in a stretched manner to the foil shadow mask mounting arrangement 10 as described in detail below.

The foil shadow mask includes a large number of apertures through which three electron beams pass to impinge only on the phosphor lines of a given color. Thus, a red light-associated electron beam (also not shown in the figure for simplicity), impinges upon the red light-associated luminescing phosphor lines 21, while green and blue light-associated electron beams respectively impinge upon green and blue light-associated luminescing phosphor lines 23 and 25.

The foil shadow mask, which is flat, is positioned on the foil shadow mask mounting arrangement 10 as described in detail below. The foil shadow mask is securely attached to the mounting arrangement 10 in order to ensure its non-deformability and rigidity and to prevent mask doming.

The tension in the foil shadow mask may be increased during the high temperature heating phases encountered during CRT manufacture. For example, while CRT operation requires that the foil shadow mask remain in registry with the phosphor display screen up to a temperature increase on the order of 100° C., CRT processing temperatures may be as high as 450° C. These high temperatures present a risk of foil shadow mask damage to those materials having a thermal coefficient of expansion less than that of the CRT glass components. This is particularly true for material such as Invar. The glass faceplate and glass-based foil shadow mask mounting structure expand to a much greater degree than the foil shadow mask during the high temperatures encountered in CRT manufacture. The increased tension applied across the foil shadow mask by these expanding glass-based components increases the likelihood that the elastic limits of the foil shadow mask will be exceeded, resulting in its permanent deformation. These problems encountered in the prior art are addressed by the foil shadow mask mounting arrangement of the present invention which allows for the increased expansion of the glass-based components of the CRT during high temperature CRT manufacture without over stressing the foil shadow mask, while maintaining the foil shadow mask in registry with the phosphor elements at the lower operating temperatures of the CRT.

Figure 2:
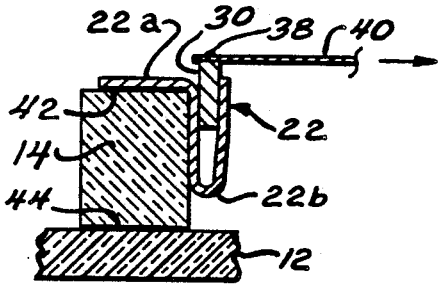
FIG. 2 is a sectional view showing details of a portion of the foil shadow mask mounting arrangement illustrated in FIG. 1 taken along sight line 2—2 therein.

A sectional view of the first spacer 14 taken along sight line 2—2 in FIG. 1 is shown in FIG. 2. Each of the spacers is in the form of an elongated, linear member which may be comprised of glass and which is securely attached to the inner surface of the glass faceplate 12 by means of a frit-based cement 44 as shown for the first spacer 14 in FIG. 2. Securely attached to an upper surface of each of the first, second, third and fourth spacers 14, 16, 18 and 20 is a respective mounting spring 22,.24, 26 and 28. Each of the aforementioned mounting springs is securely affixed to an upper surface of its associated spacer by means of a frit-based cement 42 as shown in FIG. 2 for the case of the first spacer 14 and mounting spring 22. Securely attached to the first, second, third and fourth mounting springs 22, 24, 26 and 28 is a respective anchor 30, 32, 34 and 36. Each of the mounting springs is preferably comprised of a high strength steel. As shown for the case of the first mounting spring 22 in FIG. 2, each of the mounting springs includes a first linear portion **22*a* and a second generally U-shaped portion 22*b*. The first anchor 30 is attached to the distal end of the U-shaped portion 22*b* of the first mounting spring 22. Each of the anchors is also preferably comprised of a high strength steel and is securely attached to its associated mounting spring by means of a suitable weldment. A foil shadow mask 40 is securely attached to an upper portion of each of the respective anchors by means of a weldment 38 as shown in FIG. 2 which illustrates the attachment of the foil shadow mask 40 to the first anchor 30**.

Each of the mounting springs is biased in the closed position with a predetermined pre-load. Each of the mask anchors thus provides a nonmoving, fixed position for mounting the foil shadow mask 40 relative to the glass faceplate 12. The predetermined pre-load exerted by the mounting springs is such that the foil shadow mask 40 after being welded to each of the four anchors and severed from a foil shadow mask tensioning frame does not exert sufficient force to open the mounting springs which remain closed as shown in FIG. 2. Consequently, the foil shadow mask 40 remains in registry with the color luminescing phosphor lines on the inner surface of the glass faceplate 12 during normal CRT operation.

Figure 3:
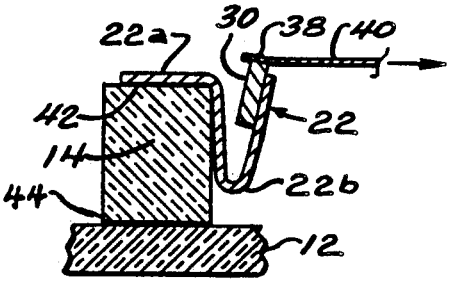
FIG. 3 shows the mounting arrangement of FIG. 2 in a stretched condition during high temperature processing of the CRT as it is manufactured.

During high temperature processing of the CRT such as in frit sealing and exhausting of the CRT bulb, the thermal expansion of the glass faceplate and glass-based spacers is greater than that of the foil shadow mask 40 which has a low thermal expansion coefficient. This causes the mounting springs to be opened as shown in FIG. 3 for the case of the first mounting spring 22 against its closed bias for limiting the increased tension exerted on the foil shadow mask and for preventing yielding or fracture of the foil shadow mask. As shown in FIG. 3, the greater expansion of the glass faceplate 12 and glass-based first spacer 14 has caused the first mounting spring 22 to open for limiting the tension applied to the foil shadow mask 40. During normal operation of the CRT, the first mounting spring 22 would assume the shape illustrated in FIG. 2. As indicated above, during normal operation of the CRT the temperature of the foil shadow mask 40 increases approximately 100° C. For a material such as Invar having a low coefficient of thermal expansion, the mounting spring for a 0.001 inch thick foil shadow mask requires a spring pre-load of only about five (5) pounds per linear inch.

Figure 4:
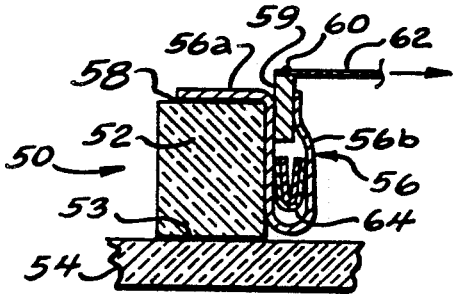
FIG. 4 is a sectional view showing details of another embodiment of a foil shadow mask mounting arrangement in accordance with the present invention.

Referring to FIG. 4, there is shown another foil shadow mask mounting arrangement 50 for securely attaching a foil shadow mask 62 to a glass faceplate 54 of a color CRT. As in the previous embodiment, a glass-based spacer 52 is securely attached to the inner surface of the glass faceplate 54 by means of a frit layer 53, while a mounting spring 56 is attached to an upper surface of the spacer 52 by means of a second frit layer 58. The mounting spring 56 includes a first linear portion **56*a* and a second generally U-shaped portion 56*b*. A distal end of the U-shaped portion 56*b* of the mounting spring 56 is securely attached such as by means of a weldment to an anchor 59. An upper surface of the anchor 59 is securely attached to an edge portion of a foil shadow mask 62 by conventional means such as a weldment 60**.

Disposed within the U-shaped portion **56*b* of the mounting spring 56 is a bi-metallic element 64. The bi-metallic element 64 is also generally U-shaped and opens and closes in accordance with its temperature. Thus, the bimetallic element 64 in a preferred embodiment will force the U-shaped portion of the mounting spring 56 open, such as shown in FIG. 3, at the high CRT processing temperatures, i.e., on the order of 435° C. At the lower operating temperatures of the CRT, i.e., on the order of 100° C., the bi-metallic element 64** assumes a contracted configuration and permits the mounting spring 56 to close as shown in FIG. 4.

Figure 5:
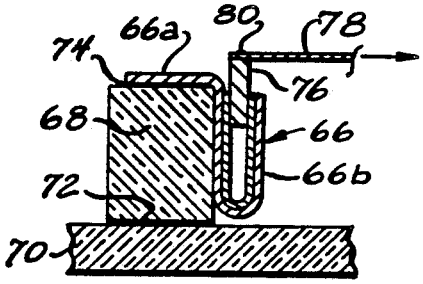
FIG. 5 is a sectional view of yet another embodiment of a foil shadow mask mounting arrangement in accordance with the principles of the present invention.

Referring to FIG. 5, there is shown yet another arrangement for securely mounting a foil shadow mask 78 to a glass faceplate 70 in a color CRT. In the arrangement of FIG. 5, the spacer 68 is attached to the glass faceplate 12 by means of a first frit layer 72 and is further attached to a mounting spring 66 by means of a second frit layer 74. In the embodiment of FIG. 5, the mounting spring 66 is comprised of a bi-metallic material and includes a first linear portion 66*a* attached to the spacer 68 and a second generally U-shaped portion 66*b*. The anchor 76 is securely attached to a distal end of the U-shaped portion 66*b* of the mounting spring 66. The anchor 76 is attached to an edge of a foil shadow mask 78 by conventional means such as a weldment 80. In the arrangement of FIG. 5, at the higher CRT processing temperatures the U-shaped portion 66*b* of the mounting spring 66 opens so as to limit the tension applied to the foil shadow mask 78. At the lower operating temperatures of the CRT, the mounting spring 66 assumes the shape shown in FIG. 5 so as to maintain the foil shadow mask 78 in registration with phosphor elements deposited on the glass faceplate.

Figure 6:
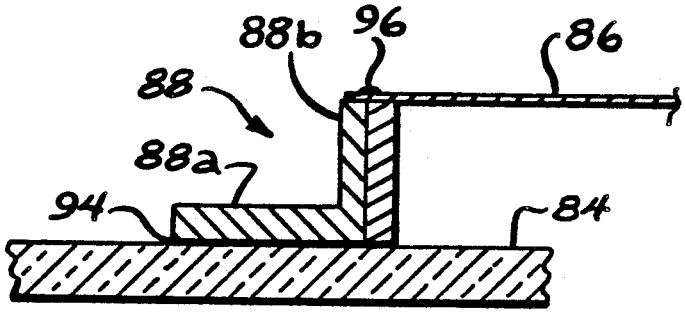
FIG. 6 is a simplified sectional view of still another embodiment of a foil shadow mask mounting arrangement in accordance with the principles of the present invention.

Referring to FIG. 6, there is shown a simplified sectional view of yet another embodiment of a mounting element 88 for securely attaching a foil shadow mask 86 to the glass faceplate 84 of a color CRT. The mounting element 88 includes a first portion 88*a* coupled to the inner surface of the glass faceplate 84 by conventional means such as a frit layer 94. The mounting element 88 further includes a second portion 88*b* extending away from the glass faceplate 84 and oriented generally transverse to the first portion 88*a* of the mounting element. A distal end of the second portion 88*b* of the mounting element 88 is coupled to a peripheral edge of the foil shadow mask 86 by conventional means such as a weldment 96. The mounting element 88 provides a single monolithic structure for securely attaching the foil shadow mask 86 to the glass faceplate 84 and is preferably comprised of a temperature responsive, bi-metallic material. The bi-metallic composition of the mounting element 88 is selected such that at the operating temperatures of the CRT (approximately 100° C.), the mounting element presents a rigid structure for securely attaching the foil shadow mask 86 to the glass faceplate 84. At the higher temperatures encountered during CRT manufacturing processes (approximately 435° C.), the second portion 88*b* of the mounting element 88 flexes toward the right as shown in FIG. 6 so as to compensate for greater expansion of the glass faceplate 84 than the foil shadow mask 86, which has a lower coefficient of thermal expansion than the faceplate. Rightward, or inward, flexure of the second portion 88*b* of the bi-metallic mounting element 88 permits the mounting element to exert an essentially constant stretching force upon the foil shadow mask 86 at both the lower CRT operating temperatures and the higher manufacture processing temperatures.

There has thus been shown a mounting arrangement for a foil shadow mask in a color CRT having a flat glass faceplate which accommodates the different coefficients of thermal expansion of the glass and metal components in the CRT front assembly. The inventive mounting arrangement includes a plurality of mounting springs attached to faceplate mounted spacers as well as to respective edges of the metal foil shadow mask which maintain the foil shadow mask in registration adjacent to the faceplate at CRT operating temperatures and prevent yielding or fracture of the foil shadow mask at substantially higher temperatures encountered during CRT manufacture. The present invention is particularly adapted for use with foil shadow masks having low coefficients of expansion which permit reduced tension to be applied to the mask allowing for the use of thinner support rails and facilitating mask installation.

While particular embodiments of the present invention have been shown and described, it will be obvious to those skilled in the art that changes and modifications may be made without departing from the invention in its broader aspects. Therefore, the aim in the appended claims is to cover all such changes and modifications as fall within the true spirit and scope of the invention. The matter set forth in the foregoing description and accompanying drawings is offered by way of illustration only and not as a limitation. The actual scope of the invention is intended to be defined in the following claims when viewed in their proper perspective based on the prior art.

I claim:

1. A color cathode ray tube shadow mask mounting arrangement, comprising:

a glass faceplate having a centrally disposed cathodoluminescent screen on an inner surface;

mask support means affixed to opposed sides of said screen; and a foil shadow mask supported on said mask support means and having a lower coefficient of thermal expansion than said faceplate which causes said mask and mask support means to be placed under extreme stress during high temperature processing of said CRT during its fabrication, said mask support means including stress relief means for preventing overstressing of said mask or said mask support means during said high temperature processing.

2. The apparatus defined by claim 1 wherein said stress relief means includes bi-metal means constructed and arranged to bend during said high temperature processing to relieve stresses in said mask and said mask support means.

3. The apparatus defined by claim 1 wherein said mask support means includes rail means affixed to said faceplate and wherein said stress relief means includes spring means between said rail means and said mask which is biased against said rail means and is of such stiffness as to be unflexed in normal operating conditions, but flexed during said high temperature thermal processing.

4. A mounting arrangement for a foil shadow mask maintained in a stretched condition in a color cathode ray tube (CRT) having a flat glass faceplate, wherein said foil shadow mask has a lower coefficient of thermal expansion than said faceplate and wherein said CRT operates at a first lower temperature and is processed during manufacture at a second substantially higher second temperature, said mounting arrangement comprising:

anchor means attached to the foil shadow mask adjacent to the edges thereof;

spacer means attached to an inner surface of the glass faceplate for maintaining the foil shadow mask a predetermined distance from the glass faceplate, wherein said spacer means has a higher coefficient of thermal expansion than the foil shadow mask; and temperature compensating mounting means for coupling said anchor means to said spacer means for preventing excessive stretching of the foil shadow mask at said second higher temperature and for maintaining the foil shadow mask in a stretched condition at said predetermined distance from the glass faceplate at the first lower temperature.

5. The mounting arrangement of claim 4 wherein said spacer means comprises a plurality of elongated, generally linear spacer elements.

6. The mounting arrangement of claim 5 wherein the foil shadow mask is generally rectangular and said spacer elements are arranged in a generally rectangular array, with each of said spacer elements disposed adjacent a respective edge of the foil shadow mask.

7. The mounting arrangement of claim 6 wherein each of said spacer elements has a glass composition.

8. The mounting arrangement of claim 6 wherein said anchor means comprises a plurality of elongated, generally linear metal strips each attached to the foil shadow mask adjacent to a respective edge thereof.

9. The mounting arrangement of claim 8 wherein said temperature compensating mounting means comprises a plurality of metal springs each coupling a metal strip to a respective one of said spacer elements.

10. The mounting arrangement of claim 9 wherein each of said metal springs includes a first portion securely attached to a respective one of said spacer elements and a flexible, resilient second portion coupled to a respective one of said metal strips.

11. The mounting arrangement of claim 10 further comprising first frit-based attachment means for attaching each of said spacer elements to the inner surface of the faceplate.

12. The mounting arrangement of claim 11 further comprising second frit-based attachment means for attaching each of said metal springs to a respective one of said spacer elements.

13. The mounting arrangement of claim 10 wherein the second portion of each of said metal strips is generally U-shaped and includes a proximal end coupled to and continuous with the first portion thereof and a distal end coupled to a respective one of said metal strips.

14. The mounting arrangement of claim 13 further comprising coupling means for attaching the second portion of each of said metal springs to a respective one of said metal strips.

15. The mounting arrangement of claim 14 wherein said coupling means includes a plurality of weldments.

16. The mounting arrangement of claim 13 wherein each of said metal springs is comprised of a temperature responsive bi-metallic material.

17. The mounting arrangement of claim 13 further comprising a bi-metallic element coupled to the second portion of each of said metal springs for facilitating extension of each of said metal springs at the second higher temperature.

18. The mounting arrangement of claim 4 wherein said foil shadow mask is comprised of Invar.

19. A mounting arrangement for maintaining a foil shadow mask having a low thermal expansion coefficient in a fixed position relative to a flat faceplate in a color cathode ray tube (CRT) and in a stretched condition, wherein said CRT operates at a first temperature and during manufacture is processed at a second temperature and wherein said second temperature is greater than said first temperature, said mounting arrangement comprising:

a plurality of spacer elements mounted to an inner surface of the CRT faceplate, wherein the spacer elements and the faceplate have a thermal expansion coefficient greater than the thermal expansion coefficient of the foil shadow mask;

a plurality of anchors each attached to a respective edge portion of the foil shadow mask; and flexible, resilient means for coupling each of said anchors to a respective spacer element, wherein said flexible, resilient means allows for greater expansion of said spacer elements than the foil shadow mask at the second greater temperature in preventing over stressing of the foil shadow mask while maintaining the foil shadow mask in a fixed position relative to the glass faceplate and in a stretched condition at the first operating temperature.

20. A mounting arrangement for a foil shadow mask maintained in a stretched condition in a color cathode ray tube (CRT) having a flat glass faceplate, wherein said foil shadow mask has a lower coefficient of thermal expansion than said faceplate and wherein said CRT operates at a first lower temperature and is processed during manufacture at a second substantially higher second temperature, said mounting arrangement comprising:

anchor means attached to the foil shadow mask adjacent to the edges thereof;

spacer means attached to an inner surface of the glass faceplate for maintaining the foil shadow mask a predetermined distance from the glass faceplate, wherein said spacer means has a higher coefficient of thermal expansion than the foil shadow mask; and temperature compensating mounting means for coupling said anchor means to said spacer means for preventing excessive stretching of the foil shadow mask at said second higher temperature and for maintaining the foil shadow mask in a stretched condition at said predetermined distance from the glass faceplate at the first lower temperature, wherein said temperature compensating mounting means comprises a plurality of metal springs.

21. A mounting arrangement for a foil shadow mask maintained in a stretched condition in a color cathode ray tube (CRT) having a flat glass faceplate, wherein said foil shadow mask has a lower coefficient of thermal expansion than said faceplate and wherein said CRT operates at a first lower temperature and is processed during manufacture at a second substantially higher second temperature, said mounting arrangement comprising:

anchor means attached to the foil shadow mask adjacent to the edges thereof;

spacer means attached to an inner surface of the glass faceplate for maintaining the foil shadow mask a predetermined distance from the glass faceplate, wherein said spacer means has a higher coefficient of thermal expansion than the foil shadow mask; and temperature compensating mounting means for coupling said anchor means to said spacer means for preventing excessive stretching of the foil shadow mask at said second higher temperature and for maintaining the foil shadow mask in a stretched condition at said predetermined distance from the glass faceplate at the first lower temperature, wherein said temperature compensating mounting means includes a plurality of metal springs each comprised of a temperature responsive bi-metallic material.

22. A color cathode ray tube shadow mask mounting arrangement, comprising:

a glass faceplate having a centrally disposed cathodoluminescent screen on an inner surface;

temperature responsive mask support means on opposed sides of said screen for relieving strain on the mask produced by temperatures above those of normal tube operation; and a foil shadow mask supported in fixed relation to said cathodoluminescent screen on said mask support means and having a lower coefficient of thermal expansion than said faceplate which causes said mask and mask support means to be placed under extreme stress during high temperature processing of said CRT during its fabrication, wherein said mask support means is rigid under lower temperature operating conditions of the cathode ray tube to maintain said mask fixed in position during CRT operation and wherein said mask support means flexes during high temperature processing of the cathode ray tube to prevent over stressing of said mask.

23. The apparatus defined by claim 22 wherein said mask support means includes first and second monolithic mounting elements.

24. The apparatus defined by claim 23 wherein each of said first and second monolithic mounting elements is comprised of a bi-metallic material.

* * * * *